US005276490A

United States Patent [19]

Bartholmae et al.

[11] Patent Number: 5,276,490

[45] Date of Patent: Jan. 4, 1994

[54] BURIED ELECTRODE DRUM FOR AN ELECTROPHOTOGRAPHIC PRINT ENGINE

[75] Inventors: Jack N. Bartholmae, Duluth; E. Neal Tompkins, Atlanta, both of Ga.

[73] Assignee: T/R Systems, Inc., Norcross, Ga.

[21] Appl. No.: 954,786

[22] Filed: Sep. 30, 1992

[51] Int. Cl.[5] ..... G03G 15/14

[52] U.S. Cl. ..... 355/274; 355/219; 355/271; 355/273

[58] Field of Search ..... 355/271–; 361/225

[56] References Cited

U.S. PATENT DOCUMENTS

| | | | |
|---|---|---|---|
| 3,832,053 | 8/1974 | Goel et al. | 355/274 |
| 3,847,478 | 11/1974 | Young | 355/274 |
| 3,890,040 | 6/1975 | Schmidlin | 355/275 X |
| 3,976,370 | 8/1976 | Goel et al. | 355/271 X |
| 4,379,630 | 4/1983 | Suzuki et al. | 355/274 |
| 4,974,027 | 11/1990 | Landa et al. | 355/273 X |
| 4,984,025 | 1/1991 | Landa et al. | 355/274 |
| 4,999,677 | 3/1991 | Landa et al. | 355/273 |
| 5,028,964 | 7/1991 | Landa et al. | 355/273 |
| 5,038,178 | 8/1991 | Hosoya et al. | 355/277 |
| 5,156,915 | 10/1992 | Wilson et al. | 355/274 X |

*Primary Examiner*—A. T. Grimley
*Assistant Examiner*—Matthew S. Smith
*Attorney, Agent, or Firm*—Ross, Howison, Clapp & Korn

[57] ABSTRACT

A buried electrode drum (48) includes a rigid core (10) over which a controlled durometer layer (12) is disposed. On the surface of the controlled durometer layer (12) is disposed a buried electrode layer (14), having electrodes (16) disposed therein along the longitudinal axis of the drum (48). The electrode layer (14) is covered by a controlled resistivity layer (18). The controlled resistivity layer (18) is operable to be contacted on the surface thereof by an electrode (24) to allow a voltage to be transferred to the underlying electrodes (16) and therefrom along the longitudinal axis of the drum (48). Various electrodes can be disposed about the peripheral edge of the drum (48) to allow any pattern to be formed on the surface of the drum (48).

15 Claims, 6 Drawing Sheets

BURIED ELECTRODE DRUM FOR AN ELECTROPHOTOGRAPHIC PRINT ENGINE

TECHNICAL FIELD OF THE INVENTION

The present invention pertains in general to electrophotographic machines, and more particularly, to the transfer medium, such as the drum or transfer belt.

BACKGROUND OF THE INVENTION

In electrophotographic equipment, it is necessary to provide various moving surfaces which are periodically charged to attract toner particles and discharged to allow the toner particles to be transferred. At present, three general approaches have been embodied in products in the marketplace with respect to the drums. In a first method, the conventional insulating drum technology is one technology that grips the paper for multiple transfers. A second method is the semi-conductive belt that passes all the toner to the paper in a single step. The third technology is the single transfer to paper multipass charge, expose and development approach.

Each of the above approaches has advantages and disadvantages. The conventional paper drum technology has superior image quality and transfer efficiency. However, hardware complexity (e.g., paper gripping, multiple coronas, etc.), media variability and drum resistivity add to the cost and reduce the reliability of the equipment. By comparison, the single transfer paper-to-paper system that utilizes belts has an advantage of simpler hardware and more reliable paper handling. However, it suffers from reduced system efficiency and the attendant problems with belt tracking, belt fatigue and handling difficulties during service. Furthermore, it is difficult to implement the belt system to handle multipass to paper configuration for improved efficiency and image quality. The third technique, the single transfer-to-paper system, is operable to build the entire toner image on the photoconductor and then transfer it. This technique offers simple paper handling, but at the cost of complex processes with image quality limitations and the requirement that the photoconductor surface be as large as the largest image.

SUMMARY OF THE INVENTION

The present invention disclosed and claimed herein comprises an image transfer element for electrophotographic marking apparatus. The transfer element includes a substantially non-conductive support surface over which an image supporting layer is disposed. The image supporting layer is fabricated from the material having a controlled surface and volume resistivity. A plurality of conductive electrodes are disposed at select regions between the image supporting layer and the support surface. The conductive electrodes have a resistivity substantially less than the resistivity of the image supporting layer.

In another aspect of the present invention, the electrodes are formed of a plurality of parallel lines that are disposed on the surface of the image supporting layer. The electrodes are disposed a predetermined distance apart and extend to the edge of the image supporting layer. An electrode roller is operable to contact the edge of the image supporting layer and the surface thereof such that a conductive path is formed between the electrode roller and the electrodes through the image supporting layer, with the underlying one of the electrodes distributing the voltage across the surface of the image supporting layer overlying of one of the electrodes.

In a further aspect of the present invention, the supporting surface is a cylindrical drum with the electrodes disposed substantially parallel to the longitudinal axis thereof. The ends of the electrodes are skewed and parallel to a line at an angle to longitudinal axis.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
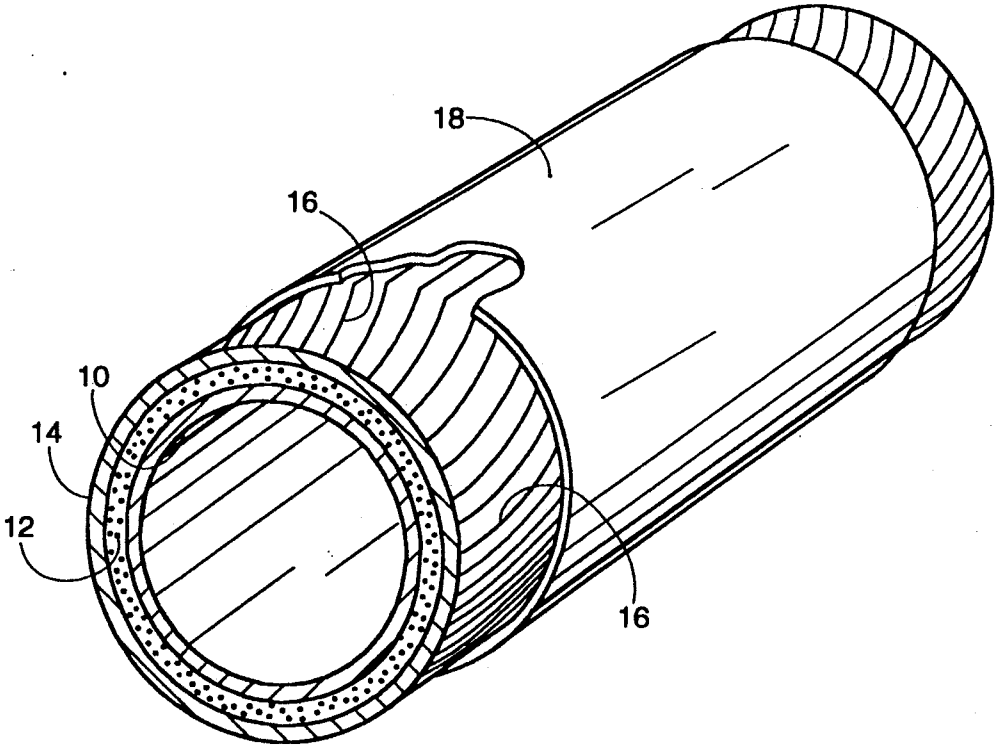
FIG. 1 illustrates a perspective view of the buried electrode drum of the present invention.

Referring now to FIG. 1, there is illustrated a perspective view of the buried electrode drum of the present invention. The buried electrode drum is comprised of an inner core 10 that provides a rigid support structure. This inner core 10 is comprised of an aluminum tube core of a thickness of approximately 2 millimeters (mm). The next outer layer is comprised of a controlled durometer layer 12 which is approximately 2–3 mms and fabricated from silicon foam or rubber. This is covered with an electrode layer 14, comprised of a plurality of longitudinally disposed electrodes 16, the electrodes being disposed a distance of 0.10 inch apart, center line to center line, approximately 0.1 mm. A controlled resistivity layer 18 is then disposed over the electrode layer to a thickness of approximately 0.15 mm, which layer is fabricated from carbon filled polymer material.

Figure 2:
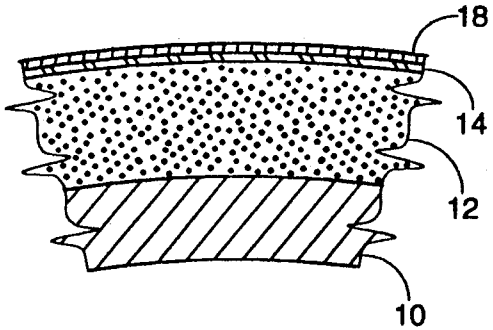
FIG. 2 illustrates a selected cross section of the drum of FIG. 1.

Referring now to FIG. 2, there is illustrated a more detailed cross-sectional diagram of the buried electrode drum. It can be seen that at the end of the buried electrode drum, the electrodes 16 within electrode layer 14 are disposed a predetermined distance apart. However, the portion of the electrodes 16, proximate to the ends of the drum on either side thereof are "skewed" relative to the longitudinal axis of the drum. As will be described hereinbelow, this is utilized to allow access thereto.

Figure 3:
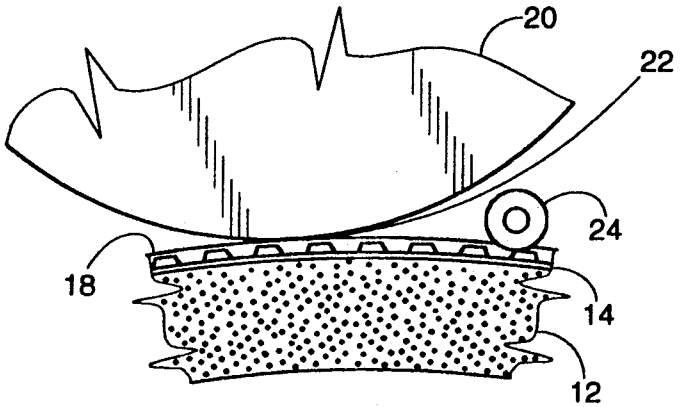
FIG. 3 illustrates the interaction of the photoconductor drum and the buried electrode drum of the present invention.

Referring now to FIG. 3, there is illustrated a side view of the buried electrode drum illustrating its relationship with a photoconductor drum 20. The photoconductor drum 20 is operable to have an image disposed thereon. In accordance with conventional techniques, a latent image is first disposed on the photoconductor drum 20 and then transferred to the surface of the buried electrode drum in an electrostatic manner. Therefore, the appropriate voltage must be present on the surface at the nip between the photoconductor drum 20 and the buried electrode drum. This nip is defined by a reference numeral 22.

A roller electrode 24 is provided that is operable to contact the upper surface of the buried electrode drum at the outer edge thereof, such that it is in contact with the controlled resistivity layer 18. Since the electrodes 16 are skewed, the portion of the electrode 16 that is proximate to the roller electrode 24 and the portion of the electrode 16 that is proximate to the nip 22 on the longitudinal axis of the photoconductor drum 20 are associated with the same electrode 16, as will be described in more detail hereinbelow.

Figure 4:
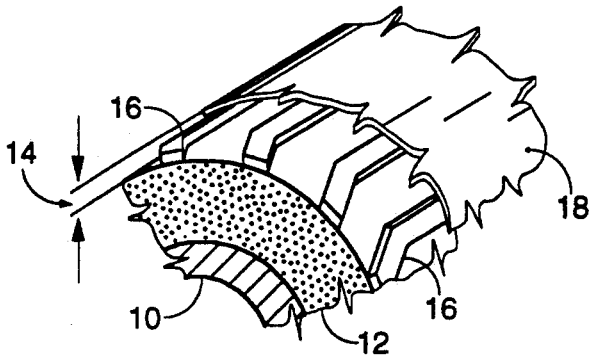
FIG. 4 illustrates a cutaway view of the electrodes at the edge of the drum.

Referring now to FIG. 4, there is illustrated a cutaway view of the buried electrode drum. It can be seen that the buried electrodes 16 are typically formed by etching a pattern on the outer surface of the controlled durometer layer 12. Typically, the electrodes 16 are initially formed by disposing a layer of thin, resistive polymer, such as Mylar TM, over the surface of the controlled durometer layer 12. An electrode structure is then bonded or deposited on the surface of the mylar layer. In the bonded configuration, the electrode pattern is predetermined and disposed in a single sheet on the mylar. In the deposited configuration, a layer of resistive material is disposed down and then patterned and etched to form the electrode structure. Although a series of parallel lines is illustrated, it should be understood that any pattern could be utilized to give the appropriate voltage profile, as will be described in more detail hereinbelow.

Figure 5A:
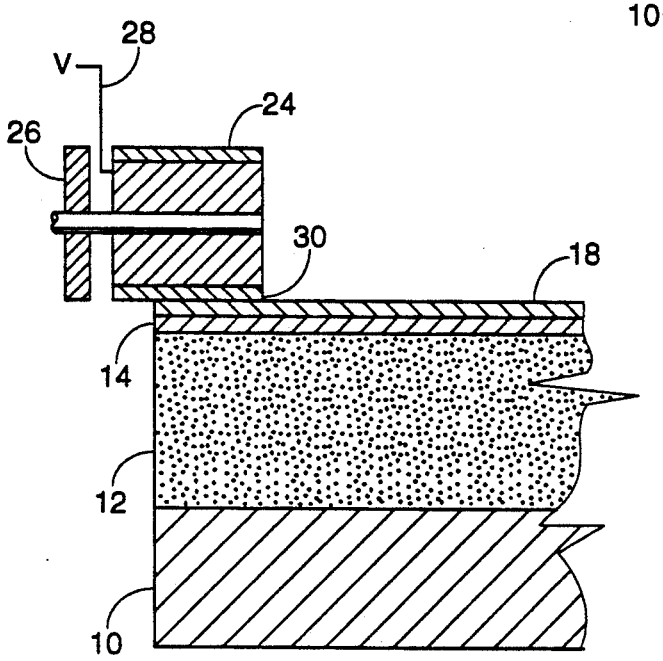
FIGS. 5*a* and 5*b* illustrate alternate techniques for charging the surface of the drum.
Figure 5B:
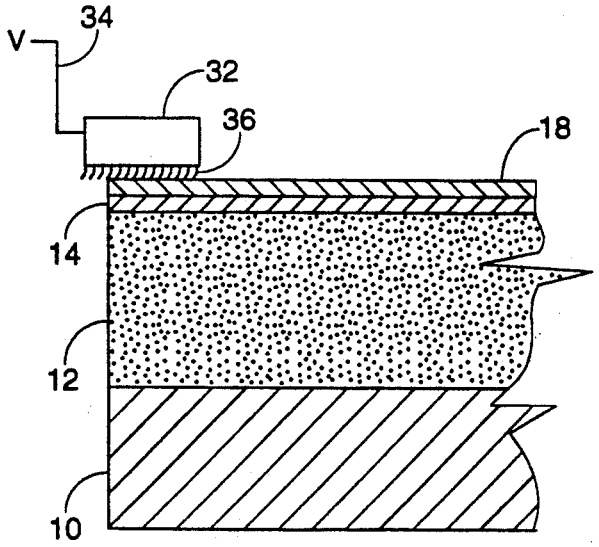

Referring now to FIGS. 5*a* and 5*b*, there are illustrated two techniques for contacting the electrodes. In FIG. 5*a*, a roller electrode is utilized comprising a cylindrical roller 24 that is pivoted on an axle 26. A voltage V is disposed through a line 28 to contact the roller 24. The roller 24 is disposed on the edge of the buried electrode drum such that a portion of it contacts the upper surface of the controlled resistivity layer 18 and forms a nip 30 therewith. At the nip 30, a conductive path is formed from the outer surface of the roller electrode 24 through the controlled resistivity layer 18 to electrode 16 in the electrode layer 14. In this manner, a conductive path is formed. The electrodes 16 in the electrode layer 14, as will be described hereinbelow, are operable to provide a low conductivity path along the longitudinal axis of the buried electrode drum to evenly distribute the voltage along the longitudinal axis.

FIG. 5*b* illustrates a configuration utilizing a brush 32. The brush 32 is connected through the voltage V through a line 34 and has conductive bristles 36 disposed on one surface thereof for contacting the outer surface of the control resistivity layer 18 on the edge of the buried electrode drum. The bristles 36 conduct current to the surface of the controlled resistivity layer 18 and therethrough to the electrodes 16 in the electrode layer 14. This operates identical to the system of FIG. 5*a*, in that the electrode 16 in the electrode layer 14 distributes the voltage along the longitudinal axis of the buried electrode drum.

Figure 6A:
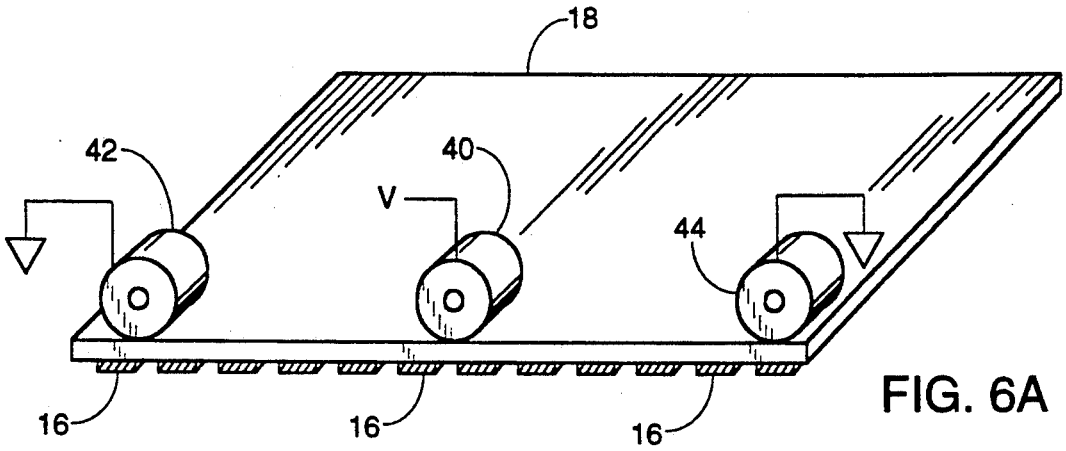
FIGS. 6*a*–6*c* illustrate the distributed resistance of the buried electrode drum of the present invention.
Figure 6B:
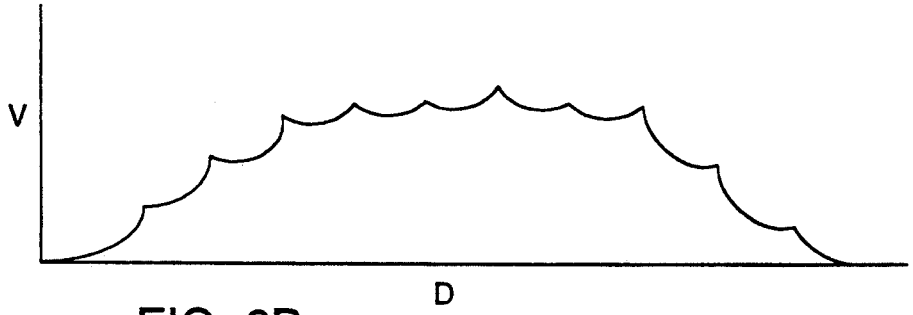
Figure 6C:
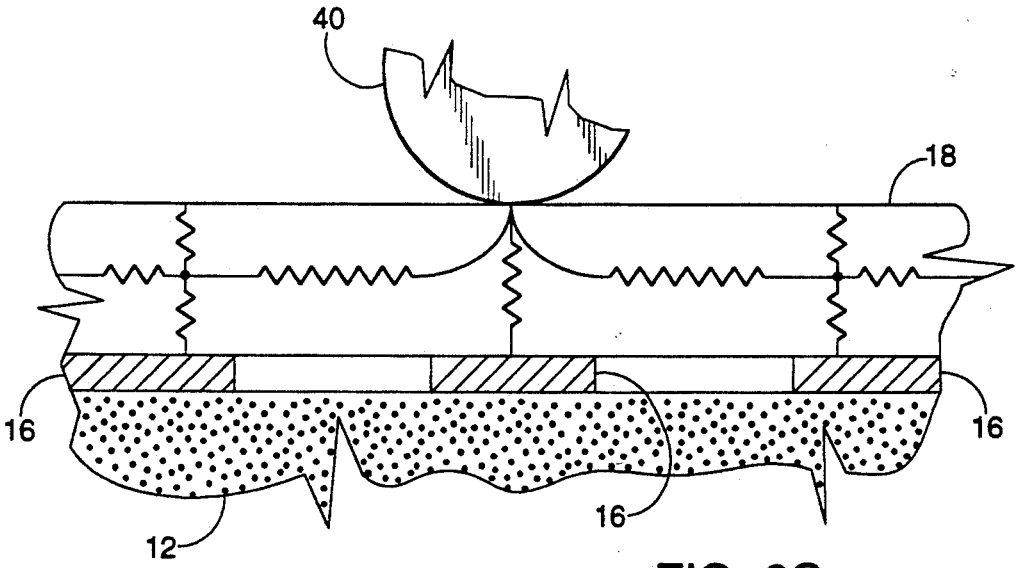

Referring now to FIGS. 6*a*–6*c*, the distribution of voltage along the surface of the electrode layer 14 will be described in more detail. The buried electrode drum is illustrated in a planar view with the electrode layer "unwrapped" from the controlled durometer layer 12 for simplification purposes. Along the length of the controlled resistivity layer 18 are disposed three electrode rollers, an electrode roller 40 connected to the positive voltage V, an electrode roller 42 connected to a ground potential and an electrode roller 44 connected to a ground potential. The electrode roller 40 is operable to dispose a voltage V on the electrode directly therebeneath, which voltage is conducted along the longitudinal axis of the drum at the portion of the controlled resistivity layer 18 overlying the electrode 16 having the highest voltage thereon. Since the electrode rollers 42 and 44 have a ground potential, current will flow through the controlled resistivity layer 18 to each of the electrode rollers 42 and 44 with a corresponding potential drop, which potential drop decreases in a substantially linear manner. However, at each electrode disposed between the roller 40 and the roller 42 and 44, the potential at that electrode 16 will be substantially the same along the longitudinal axis of the buried electrode drum. In this configuration, therefore, the electrode roller 40 disposed at the edge of the buried electrode drum is operable to form a potential at the edge of the buried electrode drum that is reflected along the surface of the buried electrode drum in accordance with the pattern formed by the underlying electrode 16. Therefore, the roller electrode 40, in conjunction with the electrode 16, act as individually addressable scorotron devices, which devices can be arrayed around the drum merely by providing additional electrode rollers at various potentials, although only one voltage profile is illustrated, many segments could be formed to provide any number of different voltage profiles.

FIG. 6*b* illustrates the potential along the length of the controlled resistivity layer 18. It can be seen that the highest potential is at the electrode 16 underlying the electrode roller 40, since this is the highest potential. Each adjacent electrode 16 has a decreasing potential disposed thereon, with the potential decreasing down to a zero voltage at each of the electrode rollers 42 and 44. The voltage profile shown in FIG. 6*b* shows that there is some lower voltage disposed between the two electrodes, due to the resistivity of the controlled resistivity layer 18.

FIG. 6*c* illustrates a detailed view of the electrode roller 40 and the resistance associated therewith. There is a distributed resistance directly from the electrode roller 40 to the one of the electrodes 16 directly therebeneath. A second distributive resistance exists between the electrode roller 40 and the adjacent electrodes 16. However, each of the adjacent electrodes 16 also has a resistance from the surface thereof upward to the upper surface of the controlled resistivity layer 18. Since the resistance along the longitudinal axis of the buried electrode drum with respect to each of the electrodes 16 is minimal, the potential at the surface of the controlled resistivity layer 18 overlying each of the electrodes 16 will be substantially the same. It is only necessary for a resistive path to be established between the surface of the roller 40 and each of the electrodes. This current path is then transmitted along the electrode 16 to the upper surface of the controlled resistivity layer 18 in accordance with the pattern formed by buried electrodes 16.

Figure 7A:
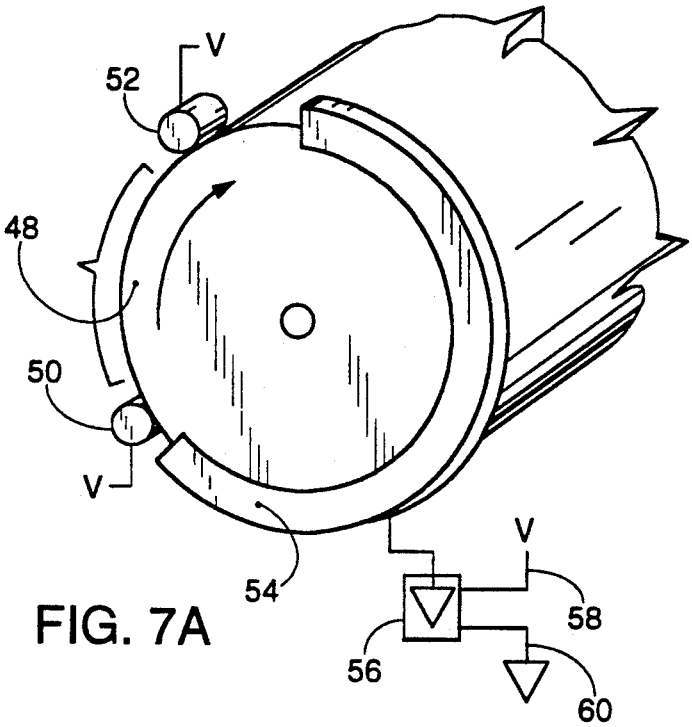
FIGS. 7*a* and 7*b* illustrate the arrangement of the charging rollers to the edge of the drum.
Figure 7B:
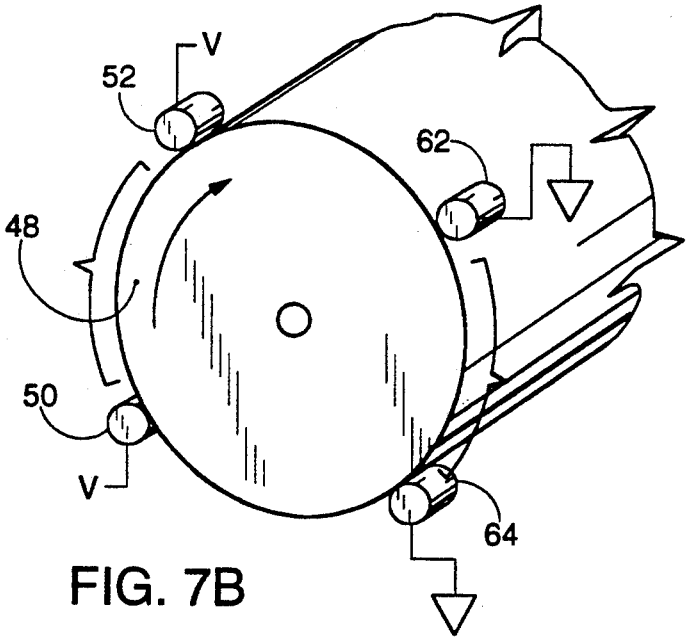

Referring now to FIGS. 7*a* and 7*b*, there are illustrated perspective views of two embodiments for configuring the rollers. In FIG. 7*a*, the buried electrode drum, referred to by a reference numeral 48, has two rollers 50 and 52 disposed at the edges thereof and a predetermined distance apart. The distance between the rollers 50 and 52 is a portion of the buried electrode drum 48 that contacts the photoconductor drum. A voltage V is disposed on each of the rollers 50 and 52 such that the voltage on the surface of the drum 48 is substantially equal over that range. A brush 54 is disposed on substantially the remaining portion of the circumference at the edge of the drum 48 such that conductive bristles contact all of the remaining surface at the edge of the drum 48. The electrode brush 54 is connected through a multiplexed switch 56 to either a voltage V on a line 58 or a ground potential on a line 60. The switch 56 is operable to switch between these two lines 58 and 60. In this configuration, one mode could be provided wherein the drum 48 was utilized as a transfer drum such that multiple images could be disposed on the drum in a multi-color process. However, when transfer is to occur, the switch 56 selects the ground potential 60 such that when the drum rotates past the electrode roller 52, the voltage is reduced to ground potential at the electrodes 16 that underlie the brush 54.

FIG. 7*b* illustrates the drum 48 and rollers 50 and 52 for disposing the positive voltage therebetween. However, rather than a brush 54 that is disposed around the remaining portion at the edge of the drum 48, two ground potential electrode rollers 62 and 64 are provided, having a transfer region disposed therebetween. Therefore, an image disposed on the buried electrode drum 48 can be removed from the portion of the line between rollers 62 and 64, since this region is at a ground potential.

Figure 8:
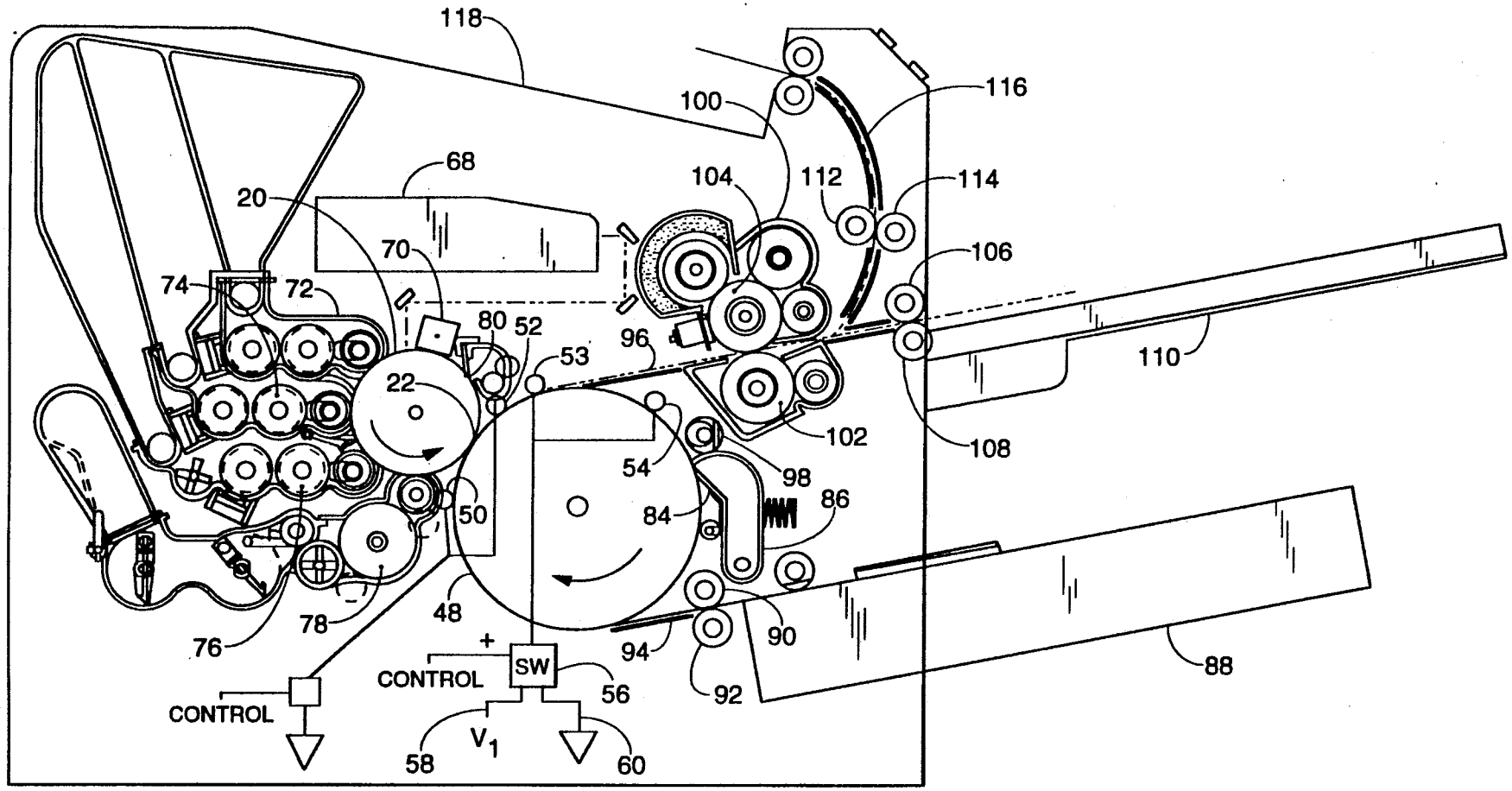
FIG. 8 illustrates a side view of a multi-pass-to-paper electrophotographic print engine utilizing the buried electrode drum.
Figure 9:
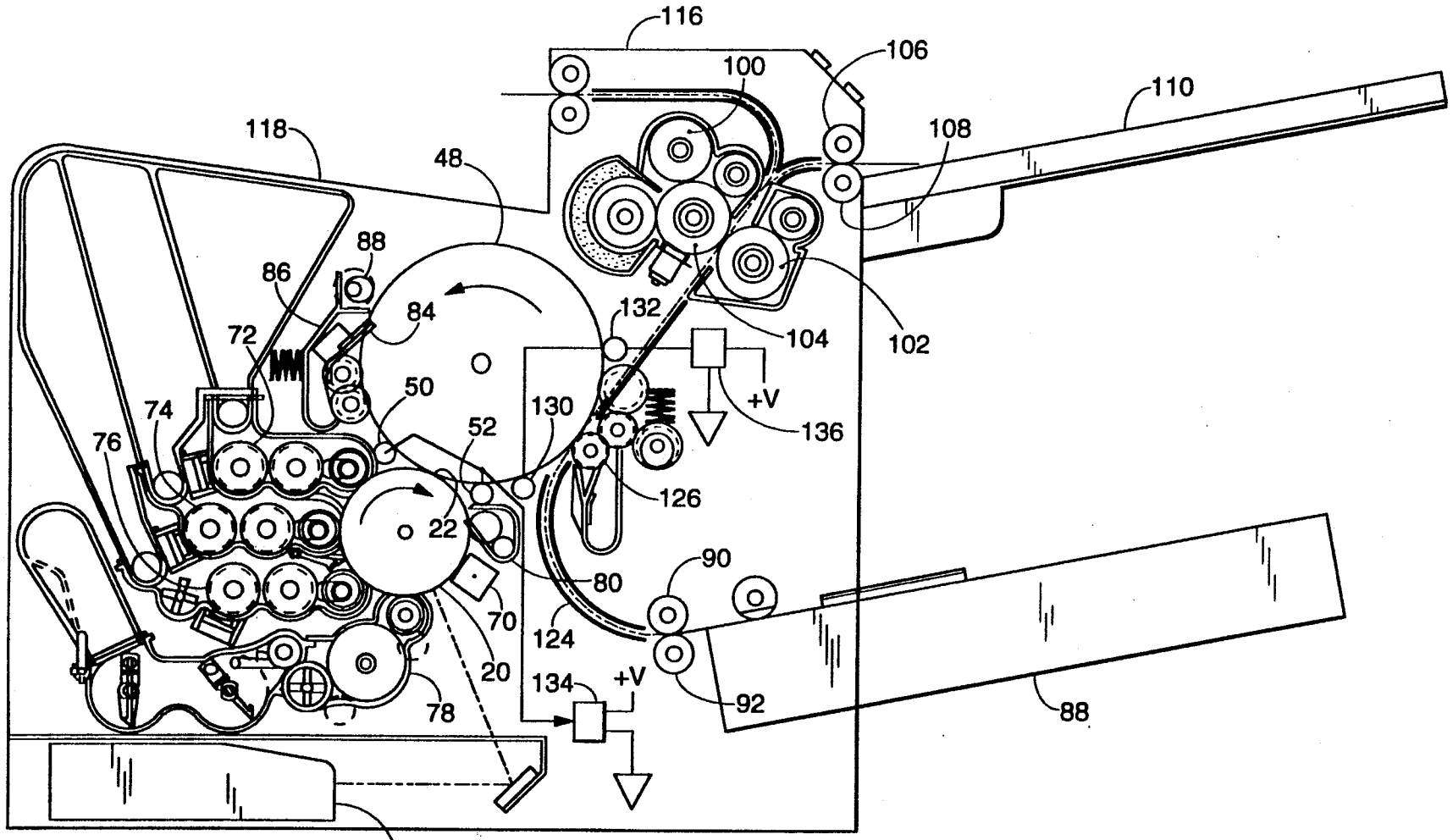
FIG. 9 illustrates a cross section of a single pass-to-paper print engine utilizing the varied electrode drum.

Referring now to FIG. 8, there is illustrated a side view of a multi-pass-to-paper print engine. The print engine includes an imaging device 68 that is operable to generate a latent image on the surface of the PC drum 20. The PC drum 20 is disposed adjacent the buried electrode drum 48 with the contact thereof provided at the nip 22. Supporting brackets [not shown] provide sufficient alignment and pressure to form the nip 22 with the correct pressure and positioning. The nip 22 is formed substantially midway between the rollers 50 and 52, which rollers 50 and 52 are disposed at the voltage V. A scorotron 70 is provided for charging the surface of the photoconductor drum 20, with three toner modules, 72, 74 and 76 provided for a three-color system, this being conventional. Each of the toner modules 72, 74 and 76, are disposed around the periphery of the photoconductor drum 20 and are operable to introduce toner particles to the surface of the photoconductor drum 20 which, when a latent image passes thereby, picks up the toner particles. Each of the toner modules 72–76 is movable relative to the surface of the photoconductor drum 20. A fourth toner module 78 is provided for allowing black and white operation. Each of the toner modules 72–78 has a reservoir associated therewith for containing toner. A cleaning blade 80 is provided for cleaning excess toner from the surface of the photoconductor drum 20 after transfer thereof to the buried electrode drum 48. In operation, a three color system requires three exposures and three transfers after development of the exposed latent images.

The buried electrode drum 48 has two rollers 52 and 54 disposed on either side of a pick up region, which rollers 52 and 54 are disposed at the positive potential V by switch 56 during the transfer operation. A cleaning blade 84 and waste container 86 are provided on a cam operated mechanism 98 such that cleaning blade 84 can be moved away from the surface of the buried electrode drum 48 during the initial transfer process. In the first transfer step, paper (or similar transfer medium) is disposed on the surface of the buried electrode drum 48 and the surface of drum 48 disposed at the positive potential V, and also for the second and third pass. After the third pass, the now complete multi-layer image is transferred onto the paper on the surface of the buried electrode drum 48.

The paper is transferred from a supply reservoir 88 through a nip formed by two rollers 90 and 92. The paper is then transferred to a feed mechanism 94 and into adjacent contact with the surface of the drum 48 prior to the first transfer step wherein the first layer of the multi-layer image is formed. After the last layer of the multi-layer image is formed, the rollers 53 and 54 are disposed at ground potential and then the paper and multi-layer image are then rotated around to a stripper mechanism 96 between rollers 53 and 54. The stripper mechanism 96 is operable to strip the paper from the drum 48, this being a conventional mechanism. The stripped paper is then fed to a fuser 100. Fuser 100 is operable to fuse the image in between two fuse rollers 102 and 104, one of which is disposed at an elevated temperature for this purpose. After the fusing operation, the paper is feed to the nip of two rollers 106 and 108, for transfer to a holding plate 110, or to the nip between two rollers 112 and 114 to be routed along a paper path 116 to a holding plate 118.

In this system, the three layers of the image are first disposed on the buried electrode drum 48 and then, after formation thereof, transferred to the paper. Initially, the surface of the drum is disposed at a positive potential by rollers 50 and 52 in the region between rollers 50 and 52. During the first pass, the first exposure is made, toner from one of the toner modules disposed on the latent image and then the latent image transferred to the actual surface of the buried electrode drum 48. During the second pass, a third toner is utilized to form a latent image and this image transferred to the drum 48. During the third pass, the third layer of the image is formed as a latent image using the second toner, which latent image is then transferred over the previous two images on the drum 48 to form the complete multi-layer image.

After the image is formed, paper is fed from the supply reservoir 88 through the nip between rollers 90 and 92 along a paper path 124 between a nip formed by a roller 126 and the drum 48. The roller 126 is moved into contact with the drum 48 by a cam operation. The paper is moved adjacent to the drum 48 and thereafter into the fuser 100. During transfer of the image to the paper, two rollers 130 and 132 are provided on either side of the nip formed between the roller 126 and the drum 48. These two rollers 130 and 132 are operable to be disposed at a positive voltage by multiplexed switches 134 and 136 during the initial image formation procedure. During transfer to the paper, the rollers 130 and 132 are disposed at a ground voltage with the switches 134 and 136. However, it should also be understood that these voltages could be a negative voltage to actually repulse the image from the surface of the drum 48.

Although the preferred embodiment has been described in detail, it should be understood that various changes, substitutions and alterations can be made therein without departing from the spirit and scope of the invention as defined by the appended claims.

What is claimed is:

1. An image transfer element for an electrophotographic marking apparatus comprising:

a substantially non-conductive support surface;

a supporting layer for supporting an image supporting sheet, said supporting layer disposed proximate to and substantially covering the support surface, said supporting layer fabricated from a material having a controlled surface and volume resistivity;

a plurality of conductive electrodes disposed at select regions between said image supporting layer and said support surface, said conductive electrodes having a resistivity of substantially less than the resistivity of said image supporting layer; and means for contacting the upper surface of said controlled resistivity material at the edge of said support surface and applying a voltage to select ones of said electrodes.

2. The transfer element of claim 1, wherein said support surface is substantially cylindrical in shape.

3. The transfer element of claim 1, wherein said support surface is comprised of a metallic core covered with a high durometer resilient material.

4. The image element of claim 1, wherein said plurality of conductive electrodes are disposed such that they extend to the edge of said supporting layer.

5. The image transfer element of claim 1, wherein said conductive electrodes are disposed in a predetermined pattern underlying said supporting layer.

6. The transfer element of claim 1, wherein said conductive electrodes are comprised of parallel lines, each being disposed adjacent each other, and disposed apart by a predetermined distance and having two portions, a first portion that is parallel to a first line, and a second portion that is parallel to a second line disposed at an angle with respect to the first line, said second portion disposed proximate to the edge of said supporting layer.

7. An electrostatic drum that is operable to provide a selectively charged surface in an electrophotographic marking apparatus, comprising:

a cylindrical and substantially non-conductive support surface;

a plurality of electrodes disposed substantially along the longitudinal axis of said support surface;

a conductive layer disposed proximate to and substantially covering said support surface and said electrodes, said conductive layer having a controlled surface and volume resistivity and operable to carry a sheet of image supporting material; and means for selectively contacting the upper surface of said conductive layer and selectively applying a voltage to select ones of said electrodes through said conductive layer such that at least two portions of said conductive layer can be at different potentials.

8. The drum of claim 7, wherein said support surface is comprised of a rigid core having a resilient and non-conductive outer coating disposed thereon.

9. The drum of claim 7, wherein said means for selectively contacting the surface comprises means for electrifying the surface in a predetermined pattern.

10. The drum of claim 7, wherein said electrodes are comprised of parallel and longitudinal lines.

11. The drum of claim 10, wherein said longitudinal lines are comprised of a first portion substantially parallel to the longitudinal axis of said support surface and a second portion substantially parallel to a line that is skewed with respect to the longitudinal axis of said support surface.

12. The drum of claim 7, wherein said means for selectively contacting the upper surface of said conductive layer comprises a contacting device that is operable to contact the upper surface of said conductive layer and select regions thereon.

13. The drum of claim 12, wherein said contacting device comprises an electrode roller for being disposed proximate to the edge of said support surface.

14. The drum of claim 12, wherein said contacting device comprises an electrode brush for contacting the outer surface of said conductive layer at the edge of said support surface.

15. The drum of claim 12, wherein a plurality of said contacting devices are provided having different voltages thereon such that their patterns can be disposed on said electrodes.

* * * * *